US006412640B1

(12) United States Patent
Destanque et al.

(10) Patent No.: US 6,412,640 B1
(45) **Date of Patent: *Jul. 2, 2002**

(54) MAKE-UP COMPACT COMPRISING AT LEAST TWO PRODUCTS OF DIFFERENT TYPES

(75) Inventors: Laurent Destanque, Rambouillet; Philippe Renault, Chaville, both of (FR)

(73) Assignee: L'Oreal, Paris (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/525,321

(22) Filed: Mar. 13, 2000

(30) Foreign Application Priority Data

Mar. 12, 1999 (FR) ..... 99 03097

(51) Int. Cl.[7] ..... B65D 71/00

(52) U.S. Cl. ..... 206/581; 206/385; 206/823; 132/297; 132/300; 220/23.4; 220/23.86

(58) Field of Search ..... 206/235, 385, 206/581, 823; 132/294, 295, 297, 300; 220/23.4, 23.83, 23.86; 248/121, 311.2, 312

(56) References Cited

U.S. PATENT DOCUMENTS

| | | | | | |
|---|---|---|---|---|---|
| 2,215,480 | A | * | 9/1940 | Sampson | 206/823 |
| 2,228,845 | A | * | 1/1941 | Picinich | 132/297 |
| 2,547,971 | A | * | 4/1951 | Polin et al. | 132/297 |
| 2,640,487 | A | * | 6/1953 | Fitz | |
| 3,637,278 | A | * | 1/1972 | Easterbrooks | 206/823 |
| 4,555,020 | A | * | 11/1985 | Campello et al. | |
| 4,579,134 | A | * | 4/1986 | Moore | |
| 5,004,106 | A | * | 4/1991 | Blumstock et al. | |
| 5,638,839 | A | * | 6/1997 | Montoli | 132/295 |
| 5,699,913 | A | * | 12/1997 | Richardson | 206/471 |
| 6,073,634 | A | | 6/2000 | Gueret | |

FOREIGN PATENT DOCUMENTS

| | | | |
|---|---|---|---|
| DE | 42 03 260 | * | 8/1993 |
| EP | 0 861 617 | * | 9/1998 |
| FR | 1 281 866 | * | 5/1962 |
| FR | 2 470 555 | * | 6/1981 |
| FR | 2 599 949 | * | 12/1987 |
| JP | 64-4310 | | 1/1989 |
| JP | 1-96111 | | 6/1989 |
| JP | 1-175611 | | 12/1989 |
| JP | 10-234466 | | 9/1998 |

* cited by examiner

*Primary Examiner*—Luan K. Bui
(74) *Attorney, Agent, or Firm*—Oblon, Spivak, McClelland, Maier & Neustadt, P.C.

(57) ABSTRACT

A two-part compact includes (a) a casing (2) having a bottom (6) delimiting at least one compartment (8*a*–8*c*) intended to contain at least a first product, for example, a make-up product ($P_1$, $P_2$, $P_3$), and at least one lid (10*a*, 10*b*) mounted on the bottom so as, selectively, to occupy an open position or a closed position in which it/they removably cover(s) the compartment(s); (b) a case (4), intended to contain a second product ($P_4$), mounted removably on the casing (2). The case (4) is mounted on the casing in such a way that it cannot be detached from the casing unless at least one of the lids (10*a*) is open. Advantageously, the first product ($P_1$, $P_2$, $P_3$) is a compact powder and the second product ($P_4$) is a stick of lipstick.

59 Claims, 2 Drawing Sheets

MAKE-UP COMPACT COMPRISING AT LEAST TWO PRODUCTS OF DIFFERENT TYPES

The invention relates to a two-part make-up compact comprising: a casing intended to contain one or more solid first product(s), and a case intended to contain a second product of solid to pasty consistency. The invention relates in particular to a make-up compact, the casing of which has a bottom. This bottom defines at least one compartment containing the first product(s) and at least one lid mounted on the bottom so as to removably cover the compartment(s). Associated with this casing is a case containing the second product, which comes in the form of a stick, for the lips, particularly a stick of lipstick.

The invention is aimed more specifically at casings of the make-up casing type comprising at least two parts articulated together about a pivot axis, of the type comprising a bottom defining at least one compartment in which the said first product(s) is/are placed, and capable of being covered with a lid, particularly a pivoting lid. The first product(s) with which the invention is concerned is/are, for example, make-up powders of the compacted or poured powder type, such as eyeshadows, foundations or blushers.

A make-up compact of the kind with which the invention is concerned is already known. Such a compact is described in FR 1,281,866. This document describes a casing secured to a case of lipstick, the opening of the casing being brought about by a translational or rotational movement of the lipstick case with respect to the casing.

The embodiment according to FR 1,281,866 has the drawback of needlessly causing the entire compact to be opened even when the user wishes only to apply make-up to her lips. An arrangement of this kind is all the more troublesome when she simply wishes to make up her lips while travelling, for example by car, train or aeroplane.

This is because, under such conditions, during the operation of applying make-up to her lips, with the casing open, the user has either to look for somewhere that she can set down the open casing or, failing that, has to hold it in one hand, in which case she runs the risk of dirtying her fingers.

Another drawback of the compact according to FR 1,281,866, lies in the fact that when carrying the make-up compact around in a handbag (where it is generally one of a number of other objects), there is the risk that the casing might accidentally open, causing the compact powder to crumble and powder residue to spill over the contents of the bag.

Furthermore, the structure of this known compact is relatively complicated, requiring an operation of fixing a pivot axle, and a spring, which increases the time and therefore costs of manufacturing the casing. A compact of this kind is therefore not suited to widespread sales.

There is also known, from U.S. Pat. No. 2,640,487, a lipstick case equipped with a device which allows this lipstick case to be attached to a make-up casing. The make-up casing has a slide, made on the outside on the bottom of the casing and capable, by snap-fastening, of receiving a tab with which the attachment device of the case of lipstick is fitted. The attachment system gives the compact an unattractive appearance. What is more, this system carries the risk of becoming caught in a handbag in which the compact is being carried.

Hence, an object of the invention is to provide a casing, of the make-up casing type, which does not have the drawbacks mentioned hereinabove with reference to the compact according to FR 1,281,866, particularly as regards the method of assembling the case with the casing.

Another object of the invention consists in providing a compact comprising a casing, in which the lid is articulated to the bottom in a simple and economical way, while at the same time offering a precision which does not deteriorate appreciably in the course of extended use. Also, the invention is advantageously aimed at a casing with an integrated hinge, such as a film hinge, which has the advantage of being simple and inexpensive to produce.

Another object of the present invention is to provide a casing which, according to an advantageous embodiment, allows the stick of lipstick to be used without the risk of losing the cap.

Yet another object of the invention is to provide a make-up compact, in which the risk of accidental opening is reduced, by comparison with the aforementioned make-up compact.

Other objects of the present invention will become clear in detail in the description which follows.

According to a first aspect of the present invention, these objects are achieved by means of a two-part compact comprising:

(a) a casing comprising a bottom delimiting at least one compartment intended to contain at least a first product, such as a make-up product, and at least one lid mounted on the said bottom so as, selectively, to occupy an open position or a closed position in which the lid or lids removably covers/cover the said compartment(s);

(b) a case intended to contain a second product mounted removably on the casing.

This assembly is characterized in that the said case is mounted on the casing in such a way that it cannot be detached from the casing unless the lid (or one of the lids) is/are open.

Advantageously, the lid(s) is/are articulated with respect to the bottom about at least one axis of articulation. Preferably, this articulation is in the form of a film hinge. This allows the bottom of the casing to be moulded as a single piece with the lid(s). Through this arrangement, the casing can be manufactured at a very economical cost, requiring no particular assembly operations.

According to an advantageous aspect of the invention, the said case comprises catching means capable of interacting, reversibly, with complementary means belonging to the casing.

To temporarily attach the case to the casing, the catching means preferably consist of an L-shaped hook. As a preference, the catching means comprises a first portion attached to the case and a second portion which has a free edge, interacting, when the compact is in the assembled position, with the said complementary means.

Advantageously, the complementary means borne by the casing consist of a slot (or notch) capable of receiving the free edge of the said second portion of the case, the said slot or notch opening into a closure plane of the casing, facing the lid, when the latter is in the closed position. Advantageously, the slot (or notch) is made near a lateral edge of the casing, that is to say an edge that is perpendicular to the axis of articulation.

Advantageously, the said lateral edge exhibits a square-sided cut-out, located on the upper face of the bottom of the casing, and opening into the slot (or notch), it being possible for the said first portion of the catching means to pass through the said square-sided cut-out.

According to one embodiment, the case has a base in which the said second product is mounted, and has a cap mounted removably on the said base in order to protect the second product. The second product is preferably in the form of a solid stick that can be disintegrated.

According to a preferred embodiment, the said catching means are integral with the cap. This arrangement has the advantage that the base of the case which carries the second product, can easily be removed from the compact and that this can advantageously be done in a direction perpendicular to the direction of the axis of articulation of the lid(s). During this operation, the cap remains secured to the casing (when the latter is in the closed position) and cannot therefore be lost.

Advantageously too, the said base can bear a mechanism which allows the said second product to be displaced axially between a retracted or storage position and a deployed position of use. A mechanism of this kind is conventional and is described, for example, in U.S. Pat. No. 4,738,559, EP-A-0,491,579 and EP-A-0,658,325, all in the name of the applicant company.

According to a preferred embodiment, the casing has a shape which is generally that of a flattened parallelepiped, of short height.

According to a particular arrangement of the invention, the bottom of the casing delimits at least two compartments capable of being covered removably with at least two separate lids, the said lids being individually articulated, with respect to the bottom, about one and the same axis of articulation. Thus, a first compartment containing, for example, a foundation, may be accessible by lifting a first lid, while a second compartment containing an eyeshadow may be uncovered by lifting a second lid.

To close each compartment, each of the lids preferably comprises a closure member capable, in the closed position, of interacting with a complementary member formed on one edge of the casing. Advantageously, the closure member is located on the opposite side of the lid to the hinge, interacting with the said complementary member. This complementary member is preferably located on the front edge of the bottom of the casing.

According to an advantageous embodiment, the first product(s) is/are packaged in one or more intermediate cups, each placed in a corresponding compartment. These cups may be mounted removably so that once they have been used up, a product can be refilled by removing the empty cup and fitting a new cup in its place.

The shade of a product is of prime importance in the realm of make-up. In order to be able to see the colours of the products packaged in the present compact, the casing and/or the cap may be made of a transparent or translucent plastic.

The first product placed in the compartment(s) is, for example, in the form of a solid product, such as a compact powder that can be disintegrated. Such a product that can be disintegrated may be obtained, for example, by compacting or pouring according to a well-known method.

The second product is preferably, as mentioned earlier, in the form of a stick which can be disintegrated. The second product may be a cosmetic or dermatological composition, for example a product for the lips, such as a stick of lipstick or a stick for protecting the lips against UV radiation.

As necessary, the bottom of the casing may have an additional compartment for housing an applicator member such as a brush or a puff.

In the detailed description which follows, which is given by way of illustrative and non-limiting example, reference will be made to the drawings, in which.

As depicted in the appended drawings, in one preferred embodiment of the invention, a make-up compact 1 comprises a casing 2, and a case 4. A bottom 6 forming part of the casing 2 defines a receptacle for three solid make-up products $P_1$ to $P_3$. Thus, in the embodiment depicted, the bottom 6 defines three compartments 8*a*, 8*b*, 8*c* intended to receive a compact powder, such as an eyeshadow or a foundation. The bottom 6 may also define another housing (not depicted) of elongate shape, able to contain an applicator member of the brush or some other type. The bottom 6 is delimited by a planar upper surface 6*d*.

Figure 4:
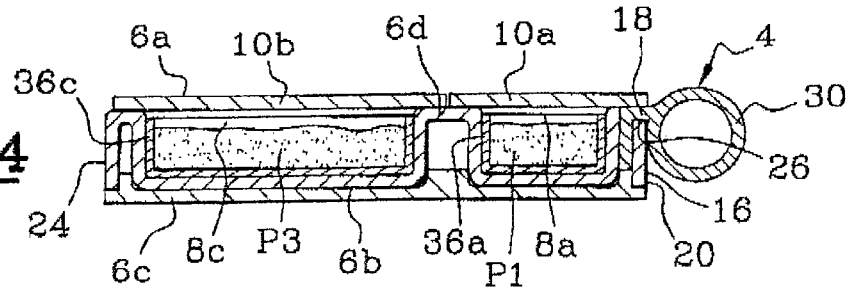
FIG. 4 depicts a view of the compact of FIG. 3 in section on the plane IV—IV.

The case 2 is of parallelepipedal overall shape, fairly flattened and of short height, and defines a front face 22, two lateral faces 20, 24, a dorsal face, an upper face 6*a* and an underside 6*b* (see FIG. 4). The underside of the casing 2 may, as necessary, be formed of an attached double bottom 6*c*, forming a surface continuous with the bottom of the casing.

Placed in each of the three compartments 8*a*, 8*b*, 8*c* is a cup 36*a*, 36*b*, 36*c*. Placed in each cup is a corresponding product that can be disintegrated. In the example being considered, the compartment 8*c*, which is larger than the other two, contains a foundation. The compartments 8*a* and 8*b* each contain an eyeshadow.

The compartment 8*c* may be closed by a lid 10*b*, the latter being articulated to the bottom 6 by a film hinge 27*b* and pivoting about an axis A. Similarly, the compartments 8*a* and 8*b* may be closed by a lid 10*a*, capable of covering these two compartments simultaneously. The lid 10*a* is articulated about the same axis A by a film hinge 27*a*. On the opposite side to the film hinges 27*a*, 27*b*, each of the lids has a closure element 32*a*, 32*b*.

Each of the closure elements 32*a*, 32*b* interacts with a complementary closure element 34*a*, 34*b* produced on the front wall 22 of the casing, so as to keep the lid in the closed position. For this purpose, the complementary closure elements 34*a*, 34*b* belonging to the front wall consist of a recess of parallelepipedal overall shape comprising a projecting part 35*a*, 35*b* capable of interacting, in the closed position, with a bulge 33*a*, 33*b* produced on the internal end of the closure elements 32*a*, 32*b*. Each of the closure elements 32*a*, 32*b* is in the form of a flexible tongue capable of flexing outwards slightly under the pulling force that the user exerts on the corresponding lid. In this way, as the lids are opened, the bulges 33*a*, 33*b* are able to pass over the corresponding projecting parts 35*a*, 35*b*.

Advantageously, the casing (and particularly the lids) is (are) made of a transparent or translucent material such as polyethylene or polypropylene so that the colour of the products $P_1$ to $P_3$ can be seen when in the closed position.

Figure 1:
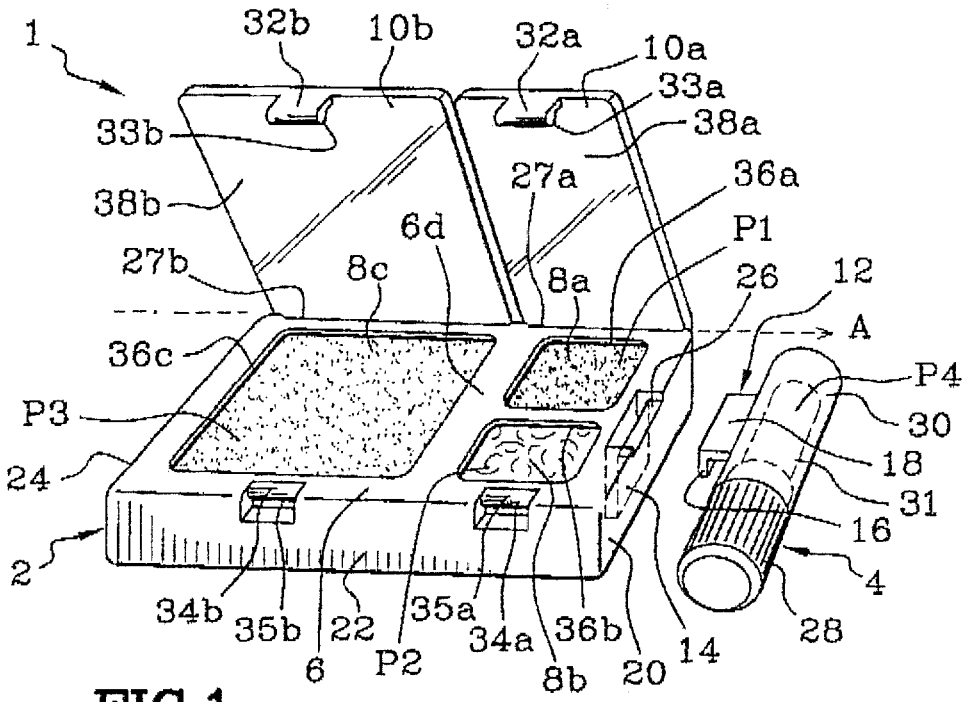
FIG. 1 depicts a perspective view of one embodiment of a make-up compact according to the present invention, in the open position, during a first stage of assembly.

In particular, when the casing 2 is made of an opaque material, the internal face of one or both lids 10*a*, 10*b* may be fitted with a mirror 38*a*, 38*b* (see FIG. 1). This allows the user to visually monitor the application of compact powder to her face.

In addition (or as an alternative), another mirror may be provided on the attached double bottom 6*c* (FIG. 4), and this has the advantage, over the above embodiment, that the user can watch herself when applying make-up to her lips, without having to open the casing.

None of these elements is the subject of the invention so these elements do not therefore require additional detailed description.

A slot or notch 14 is made in the upper surface 6*d* of the bottom 6, near the lateral edge 20. This slot or notch has an overall orientation parallel to the lateral edge 20, and constitutes a means by which the said case 4 can catch on the casing 2.

The case 4 consists of a base 28, generally cylindrical or polygonal (in section), capable of supporting a stick of product $P_4$. The base 28 has a portion 29 of smaller diameter (see FIG. 3), which can be capped by a protective cap 30, generally cylindrical or polygonal (in section) also. When the compact is in the assembled position, the base 28 and the cap 30 are aligned along an axis B (see FIG. 3), perpendicular to the front face 22 of the casing.

Figure 3:
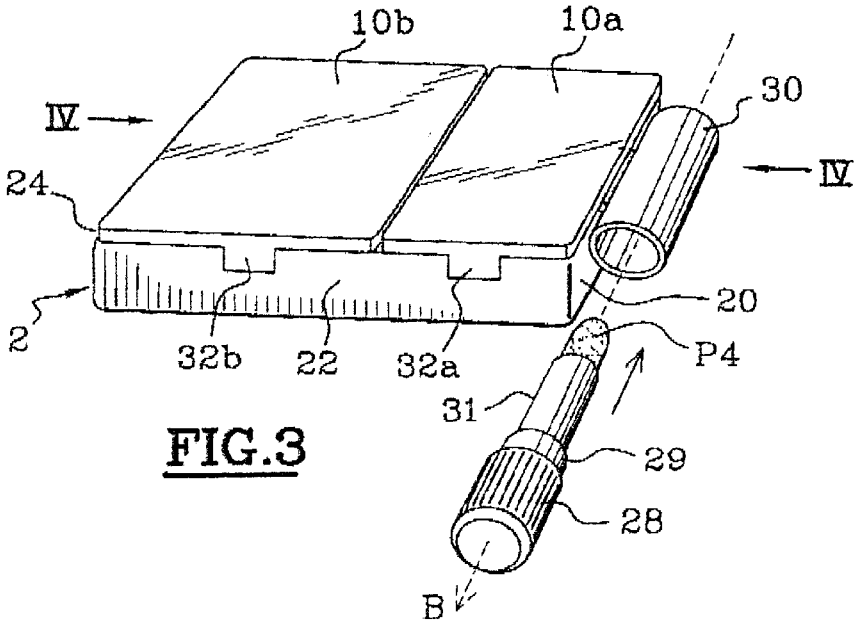
FIG. 3 depicts a perspective view of the compact of FIG. 1, during use of the lip product.

As can be seen in FIG. 3, the base 28 has a sleeve 31, which can move rotate relative to the base 28. By virtue of this sleeve 31, it is possible to position the lipstick $P_4$ in a position in which the said stick is either retracted or deployed, by means of an appropriate mechanism well known in the prior art.

To this end, and as mentioned previously, a mechanism is provided for causing the stick to move so that the stick of product $P_4$ can be displaced axially at will along the axis B. This kind of mechanism advantageously comprises a cup or support (not depicted) which can move axially and which carries the stick of product.

A drive mechanism of this kind is not the subject of the invention and is described elsewhere, in U.S. Pat. No. 4,738,559, EP-A-0,491,579 and EP-A-0,658,325. In consequence, such mechanisms require no further detailed description.

According to the invention, the cap 30 includes catching means 12 capable of being engaged in the notch or slot 14 in the bottom of the casing. Advantageously, engagement or disengagement of the catching means 12 in the notch or slot 14 is accompanied by a small amount of friction. Thus, the case 4 is retained on the casing when the lid is open, unless it is intentionally removed, and so the case is retained on the casing independent of a position of the lid. This allows the user, having opened the lid 10*a*, to apply her make-up in complete safety using the products $P_1$ and/or $P_2$, without the fear of unintentionally losing the case 4 of lipstick.

According to one essential feature of the invention, the notch or slot 14 is not therefore accessible until after the lid 10*a* has been opened. In other words, it is only when the lid 10*a* is in the open position that the case 4 can be caught onto the casing 2 or removed therefrom. On the other hand when the lid 10*a* is in a position flipped down onto the bottom 6, the case 4, and possibly the cap 30, are locked onto the casing 2 and cannot be removed.

The catching means 12 belonging to the case comprises, according to the embodiment depicted, a portion 18 extending radially outwards from the lateral wall of the cap 30. The portion 18 is bent at right angles, forming a hook with a terminal portion 16. The terminal portion 16 is shaped in such a way that (when the lid 10*a* is in the open position) it can enter the slit or notch 14. When the lid 10*a* is in the closed position, the catching means 12 belonging to the case 4 is therefore locked in place.

According to the embodiment being considered, a square-sided cut-out 26 is made on the surface 6*d* and in the lateral wall 20, to house the portion 18 of the catching means 12.

Advantageously, the cap is made of a transparent or translucent material, making it possible to see the colour of the stick of product $P_4$. This material can be selected from polyethylenes, polypropylenes, polystyrenes, polyacrylates, etc.

The use of the compact will now be explained, particularly with reference to FIG. 3.

When the user wishes to apply make-up to her lips, she, for example using her right hand, withdraws the base 28 from the cap 30 along the axis B. By twisting the base 28 with respect to the sleeve 29, the user deploys a portion of the stick of product $P_4$, to a sufficient height to allow her to make up her lips. During this operation, she holds the casing in her left hand, so as to keep the lids 10*a*, 10*b* in the closed position. This procedure makes it possible, when applying make-up to the lips, on the one hand, to make sure that the cap 30 of the case 4 remains held in place on the casing 2 and also, on the other hand, allows the user not to get her hands dirty.

Figure 5:
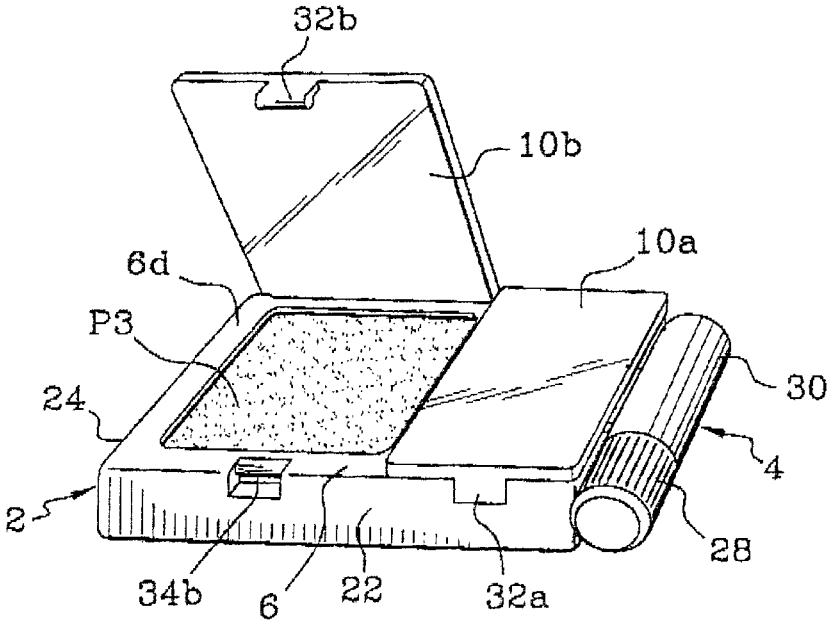
FIG. 5 depicts a perspective view of the compact of FIG. 1, during use of a compact powder.

When the user wishes to apply some foundation $P_3$, as present in the compartment 8*c*, she opens the lid 10*b* by lifting it with the thumb of her left hand while holding the right-hand part of the casing in her right hand (see FIG. 5). Taking up an amount of product $P_3$ using a finger or an appropriate applicator, she applies the said product to those areas of her face which she wishes to make up.

When the user wishes to apply an eyeshadow $P_1$ or $P_2$, as present in one of the compartments 8*a* or 8*b*, the user holds the casing 2 between the thumb and index finger of her left hand. Using the thumb of her right hand she positions the lid 10*a* in the open position. This allows her, for example using a finger of her right hand or using an applicator, to take up an amount of product $P_1$ and/or $P_2$ and apply it to her eyelids.

Figure 2:
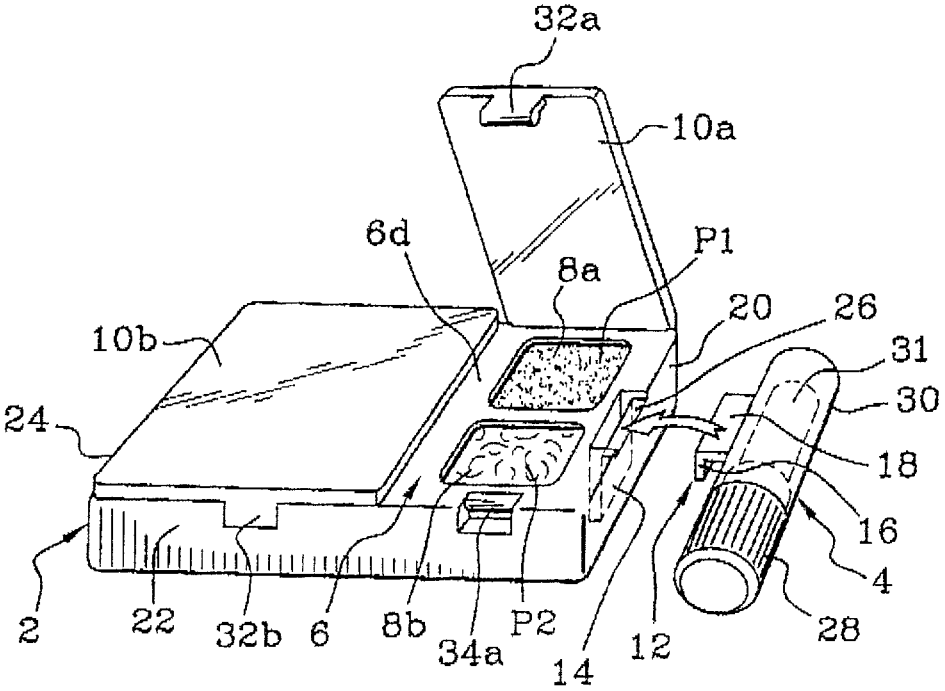
FIG. 2 depicts a perspective view of the compact of FIG. 1, during a second stage of assembly.

The friction between the catching element 12 belonging to the case 4 in the slot or notch 14 in the casing is great enough to prevent the case 4 and the casing 2 from separating during the operation of applying make-up to the eyelids (FIG. 2).

The make-up compact 1 as described, has the advantage of being refillable separately and individually in the case of each of the products $P_1$ to $P_4$. Thus, a cup of product $P_1$ to $P_3$, the contents of which have been used up, can be replaced by a new cup containing the same product or a product of a different shade.

When the stick of lipstick $P_4$ has been used up, all that is required is for the base 28 with the used-up stick to be withdrawn and replaced with a new base carrying a new stick. Likewise, simply by replacing the base 28, the user can always have the desired colour of lipstick at her disposal.

Furthermore, at the actual sales outlet, the user may choose the collection of products to be contained in the make-up compact: for example the shade of foundation or eyeshadows, or alternatively the colour of the lipstick.

The make-up compact thus formed is compact and takes up little space, making it particularly suited to being carried around in a handbag. It should be noted that, during transport, the risk of the casing 2 and the case 4 of lipstick becoming separated is practically nil.

The foregoing description makes reference to a preferred embodiment of the invention. It is obvious that variations can be made thereto without departing from the spirit of the invention as claimed hereinafter.

What is claimed is:

1. A two-part compact comprising:

a casing comprising a bottom delimiting at least one compartment configured to contain at least one first product, and at least one lid mounted on said bottom so as, selectively, to occupy an open position or a closed position in which said at least one lid removably covers said at least one compartment; and a case, configured to contain a second product, mounted removably on the casing, wherein said case is mounted on the casing such that said second product can be accessed when said at least one lid is in said closed position and such that a position of the case is not changed by a change in position of the lid as the lid is moved between said closed position and said open position, and wherein said case is mounted in such a way that said case can be detached from the casing only when of said at least one lid is open.

2. A compact according to claim 1, characterized in that the at least one lid is articulated with respect to the bottom about at least one axis of articulation.

3. A compact according to claim 1, characterized in that said case comprises catch means capable of interacting, reversibly, with complementary means provided on the casing.

4. A compact according to claim 2, characterized in that said case comprises catch means capable of interacting, reversibly, with complementary means provided on the casing.

5. A compact according to claim 4, characterized in that the catch means consists of an L-shaped hook having a first portion attached to the case and a second portion which has a free edge for interacting, when the compact is in the assembled position, with said complementary means provided on the casing.

6. A compact according to claim 5, characterized in that the complementary means consists of a slot capable of receiving the free edge of said second portion, said slot opening into a closure plane of the casing, facing the lid, when the latter is in the closed position.

7. A compact according to claim 1, characterized in that said case consists of a base in which said second product is mounted, and of a cap mounted removably on said base.

8. A compact according to claim 3, characterized in that said case consists of a base in which said second product is mounted, and of a cap mounted removably on said base.

9. A compact according to claim 8, characterized in that said catch means is integral with the cap.

10. A compact according to claim 7, characterized in that said base bears a mechanism which allows the second product to be displaced axially between a retracted/storage position and a deployed position/position of use.

11. A compact according to claim 1, characterized in that said at least one lid includes at least two lids and the bottom delimits at least two compartments capable of being covered removably with said at least two lids, said at least two lids being individually articulated, with respect to the bottom, about an axis of articulation.

12. A compact according to claim 1, characterized in that said at least one lid comprises a closure member capable, in the closed position, of interacting with a complementary member formed on an edge of the casing.

13. A compact-according to claim 1, characterized in that said at least one first product is packaged in a cup placed in the corresponding compartment.

14. A compact according to claim 8, characterized in that at least one of the casing and the cap is made of plastic that is transparent or translucent.

15. A compact according to claim 1, characterized in that the at least one first product is in a form of a compact powder which can be disintegrated.

16. A compact according to claim 1, characterized in that the second product is in a form of a stick which can be disintegrated.

17. A compact according to claim 1, characterized in that the second product is a lipstick product.

18. A two-part compact comprising:

a casing comprising a bottom delimiting at least one compartment configured to contain at least one first product, and at least one lid mounted on said bottom so as, selectively, to occupy an open position or a closed position in which said at least one lid removably covers said at least one compartment; and a case, configured to contain a second product, mounted removably on the casing, wherein said case is mounted on the casing such that the case can be detached from the casing only when at least one of said at least one lid is open, and wherein said case comprises catch means capable of interacting, reversibly, with complementary means provided on the casing, and wherein the catch means consists of an L-shaped hook having a first portion attached to the case and a second portion which has a free edge for interacting, when the compact is in the assembled position, with said complementary means provided on the casing.

19. A compact according to claim 18, characterized in that the complementary means consists of a slot capable of receiving the free edge of said second portion, said slot opening into a closure plane of the casing, facing the lid, when the latter is in the closed position.

20. A compact according to claim 18, characterized in that the complementary means consists of a notch capable of receiving the free edge of said second portion, said notch opening into a closure plane of the casing, facing the lid, when the latter is in the closed position.

21. A two-part compact comprising:

a casing comprising a bottom delimiting a compartment configured to contain a first product, and a lid mounted on said bottom so as to selectively occupy an open position, and a closed position in which said lid removably covers said compartment; and a case configured to contain a second product and mounted removably on the casing, wherein said case is mounted on the casing such that said case containing said second product is disposed outside of said casing and such that a position of the case is not changed by a change in position of the lid as the lid is moved between said closed position and said open position, and wherein said case is mounted in such a way that said case can be detached from the casing only when said lid is open.

22. A compact according to claim 21, wherein said lid is articulated with respect to the bottom about an axis of articulation.

23. A compact according to claim 21, wherein said case comprises a catch capable of interacting, reversibly, with a complementary part provided on the casing.

24. A compact according to claim 22, wherein said case comprises a catch capable of interacting, reversibly, with a complementary part provided on the casing.

25. A compact according to claim 24, wherein the catch comprises an L-shaped hook having a first portion attached to the case and a second portion which has a free edge for interacting, when the compact is in an assembled position, with said complementary part provided on the casing.

26. A compact according to claim 25, wherein the complementary part comprises a slot capable of receiving the free edge of said second portion, said slot opening into a closure plane of the casing, facing the lid, when the latter is in the closed position.

27. A compact according to claim 21, wherein said case consists of a base in which said second product is mounted, and of a cap mounted removably on said base.

28. A compact according to claim 23, wherein said case comprises a base in which said second product is mounted, and a cap mounted removably on said base.

29. A compact according to claim 28, wherein said catch is integral with the cap.

30. A compact according to claim 27, wherein said base bears a mechanism which is constructed to allow the second product to be displaced axially between a retracted/storage position and a deployed position/position of use.

31. A compact according to claim 21, further comprising at least a second lid, wherein the bottom delimits at least two compartments capable of being covered removably with said lids, said lids being individually articulated with respect to the bottom.

32. A compact according to claim 21, wherein said lid comprises a closure member capable, in the closed position, of interacting with a complementary member formed on an edge of the casing.

33. A compact according to claim 21, wherein said first product is packaged in a cup placed in the compartment.

34. A compact according to claim 21, wherein at least one of the casing and the cap is made of plastic that is transparent or translucent.

35. A compact according to claim 21, wherein the first product is in the form of a compact powder which can be disintegrated.

36. A compact according to claim 21, wherein the second product is in a form of a stick which can be disintegrated.

37. A compact according to claim 21, wherein the second product is a lipstick product.

38. A two-part compact comprising:

a casing comprising a bottom delimiting a compartment configured to contain a first product, and a lid mounted on said bottom so as to selectively occupy an open position, and a closed position in which said lid removably covers said compartment; and a case configured to contain a second product and mounted removably on the casing, wherein said case is mounted on the casing such that the case can be detached from the casing only when said lid is open, wherein said case comprises a catch capable of interacting, reversibly, with a complementary part provided on the casing, and wherein the catch comprises an L-shaped hook having a first portion attached to the case and a second portion which has a free edge for interacting, when the compact is in an assembled position, with said complementary part provided on the casing.

39. A compact according to claim 38, wherein the complementary part comprises a slot capable of receiving the free edge of said second portion, said slot opening into a closure plane of the casing, facing the lid, when the latter is in the closed position.

40. A compact according to claim 38, wherein the complementary part comprises a notch capable of receiving the free edge of said second portion, said notch opening into a closure plane of the casing, facing the lid, when the latter is in the closed position.

41. A two-part compact comprising:

a casing comprising a bottom delimiting a compartment containing a disintegratable powder, and a lid mounted on said bottom so as to selectively occupy an open position, and a closed position in which said lid removably covers said compartment; and a case containing a stick shaped product and mounted removably on the casing such that said stick shaped product can be accessed when said lid is in said closed position, wherein said case includes a projection which at least partially extends between said lid and said bottom of said casing such that said projection cannot be removed from between said lid and said bottom when said lid is in the closed position, whereby said case cannot be detached from the casing unless said lid is open.

42. A two-part compact as recited in claim 41, wherein said casing includes at least one of a slit and a notch which receives said projection when said case is mounted on said casing.

43. A two-part compact as recited in claim 42, wherein said case includes a cap, and wherein said projection extends from said cap.

44. A two-part compact as recited in claim 42, wherein said at least one of a slit and a notch removably holds said projection when said lid of said casing is in said open position.

45. A two-part compact as recited in claim 44, wherein said projection includes a hook.

46. A two-part compact as recited in claim 41, wherein said case includes a base which holds said stick shaped product, and wherein said case further includes a cap, and farther wherein said base is removably coupled to said cap both when said lid is open and when said lid is closed, and said cap can be detached from said casing only when said lid is open.

47. A two-part compact as recited in claim 41, wherein said projection includes a hook.

48. A two-part compact comprising:

a casing comprising a bottom delimiting a compartment containing a disintegratable powder, and a lid mounted on said bottom so as to selectively occupy an open position, and a closed position in which said lid removably covers said compartment; and a case containing a lipstick product and mounted removably on the casing such that said case containing said lipstick product is disposed outside of the casing, wherein said case includes a projection which at least partially extends between said lid and said bottom of said casing such that said projection cannot be removed from between said lid and said bottom when said lid is in the closed position, whereby said case cannot be detached from the casing unless said lid is open.

49. A two-part compact as recited in claim 48, wherein said casing includes at least one of a slit and a notch which receives said projection when said case is mounted on said casing.

50. A two-part compact as recited in claim 49, wherein said case includes a cap, and wherein said projection extends from said cap.

51. A two-part compact as recited in claim 49, wherein said at least one of a slit and a notch removably holds said projection when said lid of said casing is in said open position.

52. A two-part compact as recited in claim 51, wherein said projection includes a hook.

53. A two-part compact as recited in claim 48, wherein said projection includes a hook.

54. A two-part compact as recited in claim 48, wherein said case includes a base which holds said lipstick product, and wherein said case further includes a cap, and further wherein said base is removably coupled to said cap both when said lid is open and when said lid is closed, and said cap can be detached from said casing only when said lid is open.

55. A two-part compact comprising:

(a) a casing comprising:

(i) a bottom having a compartment containing at least one product;

(ii) a lid mounted on said bottom, wherein said lid is movable between an open position, and a closed position in which said lid removably covers said compartment; and (b) a case containing a stick shaped product, said case comprising:

(i) a cap removably mounted upon said casing such that said cap can be detached from said casing when said lid is in the open position but said cap is prevented from being detached from said casing when said lid is in the closed position;

(ii) a base which holds said stick shaped product, and wherein said base is removably coupled to said cap such that said base can be detached from said cap both when said lid is in said open position and when said lid is in said closed position.

56. A two-part compact as recited in claim 55, wherein said cap includes a projection which at least partially extends between said lid and said bottom of said casing to prevent detachment of said cap from said casing when said lid is in the closed position.

57. A two-part compact as recited in claim 56, wherein said casing includes at least one of a slot and a notch which receives said projection.

58. A two-part compact comprising:

a casing comprising a bottom delimiting at least one compartment configured to contain at least one first product, and at least one lid mounted on said bottom so as, selectively, to occupy an open position or a closed position in which said at least one lid removably covers said at least one compartment; and a case, configured to contain a second product, mounted removably on the casing, wherein said case is mounted on the casing such that said second product can be accessed when said at least one lid is in said closed position, and further wherein said case is mounted in such a way that said case can be detached from the casing only when at said at least one lid is open.

59. A two-part compact comprising:

a casing comprising a bottom delimiting at least one compartment configured to contain at least one first product, and at least one lid mounted on said bottom so as, selectively, to occupy an open position or a closed position in which said at least one lid removably covers said at least one compartment; and a case, configured to contain a second product, mounted removably on the casing, wherein when said case is mounted on said casing such that said second product can be accessed when said at least one lid is in said closed position, and wherein, said case is held in a first position when said at least one lid is in the closed position, and wherein said case is mounted such that it cannot be detached from said casing when said at least one lid is in the closed position, and further wherein upon opening of said at least one lid said case is selectively held in said first position such that a user can optionally maintain said case in said first position or move said case from said first position to detach said case from said casing.

* * * * *

UNITED STATES PATENT AND TRADEMARK OFFICE

CERTIFICATE OF CORRECTION

PATENT NO. : 6,412,640 B1
DATED : July 2, 2002
INVENTOR(S) : Laurent Destanque et al.

It is certified that error appears in the above-identified patent and that said Letters Patent is hereby corrected as shown below:

Column 7,
Line 6, delete “of”.
Line 51, delete “-”.

Column 10,
Line 21, change “farther” to -- further --.

Column 12,
Line 7, delete “at” (first occurrence).

Signed and Sealed this

Twenty-ninth Day of October, 2002

*Attest:*

*Attesting Officer*

JAMES E. ROGAN
*Director of the United States Patent and Trademark Office*